United States Patent [19]

Brown

[11] Patent Number: 4,548,053

[45] Date of Patent: Oct. 22, 1985

[54] COMBINED COLD COMPRESSOR/EJECTOR HELIUM REFRIGERATOR

[75] Inventor: Donald P. Brown, Southold, N.Y.

[73] Assignee: The United States of America as represented by the United States Department of Energy, Washington, D.C.

[21] Appl. No.: 617,656

[22] Filed: Jun. 5, 1984

[51] Int. Cl.[4] ..... F25B 1/06

[52] U.S. Cl. ..... 62/500; 62/514 R

[58] Field of Search ..... 62/514 R, 500, 116

[56] References Cited

U.S. PATENT DOCUMENTS

| | | | |
|---|---|---|---|
| 3,447,339 | 6/1969 | Rietdijk | 62/514 R |
| 3,611,740 | 10/1971 | Giger | 62/514 R |
| 4,189,930 | 2/1980 | Davydov et al. | 62/514 R |
| 4,242,885 | 6/1981 | Quark et al. | 62/514 R |

OTHER PUBLICATIONS

Brown et al: "Design of a 24.8 kW, 3.8-K Cryogenic System for Isabelle", Advances in Cryogenic Engineering, vol. 27, New York, 1982.

Brown et al: "Cycle Design for the Isabelle Helium Refrigerator", Advances in Cryogenic Engineering, vol. 27, New York, 1982.

Brown et al: "Cycle Design for the Isabelle Helium Refrigerator" (BNL 30006), published by Brookhaven National Laboratory presented as paper at 1981 Cryogenic Engineering Conference at San Diego, Cal., 8/10-14, 1981.

Ku et al: "A Helium Refrigerator with Features for Supercritical Pressure Cooling" (BNL 33592), published by Brookhaven National Laboratory presented at the Cryogenic Engineering Conf, Aug. 15-19, 1983.

*Primary Examiner*—Ronald C. Capossela

*Attorney, Agent, or Firm*—Vale P. Myles; James W. Weinberger; Judson R. Hightower

[57] ABSTRACT

A refrigeration apparatus having an ejector operatively connected with a cold compressor to form a two-stage pumping system. This pumping system is used to lower the pressure, and thereby the temperature of a bath of boiling refrigerant (helium). The apparatus as thus arranged and operated has substantially improved operating efficiency when compared to other processes or arrangements for achieving a similar low pressure.

5 Claims, 4 Drawing Figures

COMBINED COLD COMPRESSOR/EJECTOR HELIUM REFRIGERATOR

The U.S. Government has rights in this invention pursuant to Contract Number DE-AC02-76CH00016, between the U.S. Department of Energy and Associated Universities Inc.

BACKGROUND OF THE INVENTION

The invention relates to refrigeration systems and, more particularly, to a refrigeration apparatus that is effective to significantly improve the operating efficiency of a system that includes an ejector operatively connected to move refrigerant between a heat exchanger and a precooler vessel. The invention is particularly useful in raising refrigeration efficiency and capacity in refrigeration systems that are operated to produce cooling below 4.2° K. (Kelvin).

One relatively recent application of such an ultra-cold producing refrigeration system was in conjunction with the cooling of super-conducting magnets, which were to be employed in a combination storage ring/accelerator that was to be constructed and operated at Brookhaven National Laboratory. That proposed system was designed to be operated to produce magnet cooling at 3.8° K., using a forced-flow supercritical helium coolant system. Historically, in the design and construction of such ultra cold systems, the main or so-called warm compressor, or vacuum pump has been used to pump a cold helium bath in the system to a desired pressure. Those familiar with the art know that such an approach has several major disadvantages. An alternative approach is to use a helium ejector which is able to convert refrigeration from 4.5° K. to lowered temperatures without requiring connections to ambient temperature. Because of that feature, even though helium ejectors are not very efficient, they are recognized as a desirable, simple mechanical element and are widely used in ultra-low temperature refrigeration circuits.

Experience with such ultra-cold refrigeration systems has indicated that only about one-third of the refrigeration that is produced at 4.5° K. can be effectively transferred and made available for cooling the magnets, or other desired load, at about 3.8° K. Although the remainder of the cooling effect can be used for liquification or other purposes within the refrigeration system, it cannot be regarded as directly useful in cooling the load at the desired lower temperature.

In recent attempts to improve the efficiency of delivering refrigeration availability to the load, the benefit of using cold compressors in association with a cold expander was studied, as reported for example by the present applicant and his co-workers in a paper entitled, "Cycle Design for the ISABELLE Helium Refrigerator", which was published by Plenum Press, New York (1982) in *Advances in Cryogenic Engineering*, Vol. 27 (pg. 501, et seq). Even with the benefits of such cold expander/cold compressor systems now established, it remains desirable to still further improve the operating efficiency of ultra-cold refrigeration systems.

SUMMARY OF THE INVENTION

It is a major object of the invention to provide a refrigeration apparatus that utilizes an operably connected cold compressor to significantly improve the operating efficiency of the apparatus.

Another object of the invention is to provide a refrigeration apparatus that includes an ejector connected between a heat exchanger and a precooler vessel, with an improvement that enables the ejector discharge pressure to be reduced by a cold compressor, in order to improve the operating efficiency of the refrigeration apparatus.

A further object of the invention is to provide a two-stage pumping system in an ultra-cold refrigeration apparatus in order to significantly improve the refrigeration capability of the apparatus relative to a similar system that utilizes a single stage pumping means.

Additional objects and advantages of the invention will be apparent to those skilled in the art from the disclosure of it presented herein.

In one preferred embodiment of the invention an ultra-cold refrigeration apparatus is provided including a heat exchanger, a precooler, a subcooler and an ejector, all operably interconnected with suitable conduit means, which are arranged to carry a compressible refrigerant, such as helium, from the heat exchanger through the ejector and the precooler, in a loop back to the heat exchanger. According to the invention, the refrigeration apparatus is improved by including a cold compressor operably connected by means of conduit, and responsive to operation of the cold compressor, to reduce the discharge pressure of the ejector, thus improving the overall operating efficiency of the refrigeration apparatus.

DESCRIPTION OF THE PREFERRED EMBODIMENT

Figure 1:
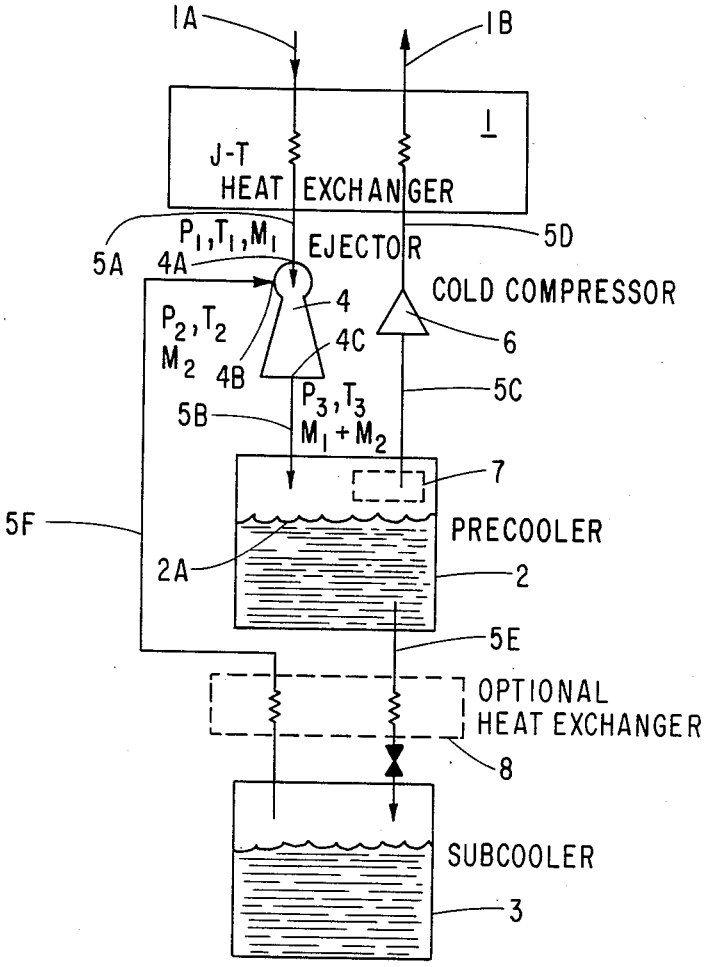
FIG. 1 is a schematic diagram of a refrigeration apparatus that includes a cold compressor operably connected according to the invention.

In order to simplify the description of the invention, there is shown a preferred embodiment of it in FIG. 1, wherein a conventional J-T heat exchanger of a helium cooled refrigeration circuit is operatively connected to the load of the refrigeration apparatus of the invention. It should be understood that the illustrated J-T heat exchanger 1 can be connected in any suitable manner to any such well-known type of basic refrigeration circuit; thus, only the input and discharge lines 1A and 1B of that circuit are shown in FIG. 1. It will also be recognized that load arrangements other than the illustrated J-T heat exchanger 1, can be used in practicing the present invention; accordingly, in the following discussion it should be understood that the heat exchanger 1 can be replaced with such alternative arrangements in modified embodiments of the invention.

In addition to the J-T heat exchanger 1, the refrigeration apparatus of the invention includes a suitable conventional precooler 2, that can be any well known kind of vessel. The apparatus also includes a subcooler 3 and an ejector 4, both of which components may take any suitable conventional form. The components 1-4 are interconnected with suitable conventional conduit means 5A-5F, which are effective to carry refrigerant, such as helium, from the heat exchanger 1 to a first (primary) input 4A of the ejector 4, then from the output 4C of the ejector to the precooler 2. From the precooler, the conduit means is effective to carry refrigerant through the conduit portions 5C and 5D back to the J-T heat exchanger 1, while a second conduit portion 5E is effective to carry refrigerant from the precooler 2 to the subcooler 3. Finally, the conduit means portion 5F is effective to carry refrigerant from the subcooler 3 to a second (secondary) input 4B of ejector 4, as shown in FIG. 1.

The refrigeration apparatus as described thus far is improved, according to the invention, by operably connecting a cold compressor 6, by the conduit means portions 5C and 5D, so that the cold compressor 6 is effective to reduce the discharge pressure ($P_3$) of ejector 4 and thereby improve the operating efficiency of the refrigeration apparatus. Thermodynamic analysis indicates that the efficiency of an ejector can be improved if its discharge pressure is reduced. We have found that a cold compressor, such as the cold compressor 6, can be introduced in series with an ejector, for example as shown in FIG. 1, to produce such a desired low pressure at the output or discharge port 4C of the ejector.

It should be understood that although the location of the cold compressor 6 is shown in FIG. 1 as being at the low pressure side of the J-T heat exchanger 1, the invention can be practiced by locating the cold compressor 6 at other appropriate locations relative to the remaining components of the refrigeration apparatus shown in FIG. 1. For example, the cold compressor 6 could be operably connected by the conduit means portion 5B to reposition the compressor 6 between the output 4C of ejector 4 and the precooler 2. In still another alternative embodiment of the invention, the compressor 6 could be operably connected, for example, above the J-T heat exchanger 1 where, typically, the exhaust from an expander in a conventional refrigeration circuit is introduced. By operably connecting the cold compressor 6 with suitable conduit means to the downstream side of the heat exchanger 1, it will be seen that the compressor 6 and ejector 4 are arranged to form a two-stage pumping system for moving refrigerant from the first input 4A of the ejector to the down-stream side 1B of the heat exchanger 1.

When arranged in such a fashion, the cold compressor 6 is not required to pump all the way to the lowest pressure in the associated refrigeration system. Accordingly, the amount of heat introduced from the work of compressor 6 will thereby be minimized. It will be seen that, at the same time, the pumping capacity of the ejector 4 is significantly enhanced due to the lower pressure ratio across it. Consequently, the net result is to provide a refrigerator apparatus which has a substantially improved operating efficiency over the simple ejector cycle, does not require the use of a cold expander, and requires the minimum amount of compressor work.

It has been found that the refrigeration apparatus shown in FIG. 1 can be further improved in operating efficiency, according to the invention, by operably mounting a suitable conventional mist eliminator 7, that is connected by the conduit means portion 5C, between the precooler 2 and the cold compressor 6, as shown by dashed lines in FIG. 1. It will be recognized that the mist eliminator 7 must be arranged in the precooler 2 above the level 2A of condensed liquid in the precooler in order to operate effectively. When thus mounted, the mist eliminator 7 is effective to prevent liquid from being carried from the precooler 2 to the cold compressor and thereby improves the operating efficiency of the cold compressor.

Finally, there is illustrated in FIG. 1 an optional heat exchanger 8, which may be arranged as shown in FIG. 1 to further enhance the overall operating efficiency of the refrigeration apparatus, in modified embodiments of the invention, if desired. It will be recognized that other suitable modifications and alterations of the basic two-stage pumping means of the invention can be developed from the disclosure presented herein.

The components 1 through 5 of the refrigeration apparatus shown in FIG. 1 may each be formed of any suitable conventional form that is readily available commercially. The cold compressor 6, used in the preferred embodiment of the invention shown in FIG. 1, is a centrifical, oil-bearing type compressor having an oil skid to provide the compressor bearing oil and also to provide oil for the associated turbine (not separately shown) that drives the compressor. Warm helium is used as a seal gas to prevent migration of bearing oil into the refrigeration process. In initial experiments with the refrigeration apparatus shown in FIG. 1, the warm helium gas pressure was maintained at about 0.25 atmospheres above the shaft side impeller gas pressure; however, it was later found that the warm helium gas over pressure could be safely reduced to about 0.07 atmospheres. That reduced pressure difference is used in the preferred embodiment to minimize flow of the warm helium seal gas into the refrigeration process and is still sufficient to prevent bearing oil migration into the process fluid. A shrouded wheel, of about 4 centimeters diameter, is used to pressurize the warm helium seal gas. The design specifications for the cold compressor 6, used in the preferred embodiment of the invention are given in the following Table I:

TABLE I

| Cold Compressor (6) Design Specifications | |
|---|---|
| Inlet Pressure | 0.95 Atmospheres |
| Inlet Temperature | 4.2° K. |
| Outlet Pressure | 1.4 Atmospheres |
| Rotation Speed | 41,000 r.p.m. |
| Efficiency | 50% |

Figure 2:
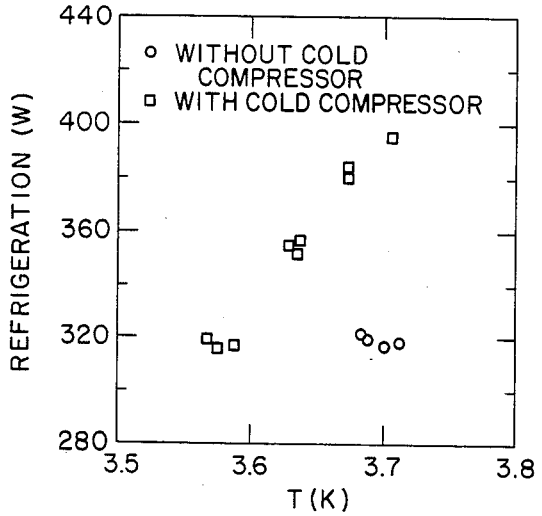
FIG. 2 is a graph that illustrates the refrigeration capacity of the apparatus shown in FIG. 1, for the two conditions when; (1) the apparatus is operated with a cold compressor and (2) when the apparatus is operated without a cold compressor.

In order to test and prove the effectiveness of the refrigeration apparatus of the invention, as it was assembled and operated in the configuration shown in FIG. 1, several tests were conducted. The results of a first series of such tests are shown in FIG. 2, which is a graphic illustration of refrigeration capacity in watts (W) as a function of load temperature, shown in degrees Kelvin (K). When the apparatus shown in FIG. 1 was operated in four test runs, without the cold compressor 6 operably connected in the circuit, for a given load of 320 W (watts), the apparatus with ejector 4 alone was found to produce a load temperature of about 3.7° K., as shown by the four circles plotted in FIG. 2. Three further test runs were conducted on the apparatus shown in FIG. 1, with the cold compressor 6 operatively connected to form the second stage of a two-stage pumping system including the ejector 4 and the cold compressor, according to the invention. For the same given load, i.e. 320 W, it was found that the load temperature was reduced to 3.6° K., as shown by the three squares in FIG. 2 at approximately the intersection of a line drawn from the 320 W refrigeration capacity value and a vertical line extended from about the 3.6° K. area. When those three test runs were extended to measure data for a given temperature of about 3.7° K., it was found that the combined ejector and cold compressor apparatus increased the cooling load to about 390 W (watts), as shown by the uppermost three squares in the graph of FIG. 2. Since for the given temperature of 3.7° K., with only the ejector 4 operating in the refrigeration apparatus of FIG. 1 (i.e., without the cold compressor 6) the cooling load was only 320 W, while with the addition of cold compressor 6 a cooling load of 390 W was produced for the 3.7° K. temperature, it can be seen that a gain in operating efficiency of about 20% is realized with the two-stage pumping system of the preferred embodiment of the refrigeration apparatus of the invention.

As pointed out above, the cold compressor 6 can be located at various positions downstream from the ejector 4, in the refrigeration apparatus shown in FIG. 1. An indication of the improvement in refrigeration efficiency of the apparatus shown in FIG. 1, by thus locating the cold compressor 6 in various arrangements downstream from the ejector 4, is given by the mass flow ratio of ejector 4. The mass flow ratio is given by $M_1/M_2$, where $M_1$ is the mass flow of the primary input 4A to the ejector 4 and $M_2$ is the mass flow of the secondary input 4B to the ejector 4, as shown in FIG. 1. The respective pressures at the first and second inputs of the ejector 4 and at its output 4C are designated in FIG. 1 by the symbols $P_1$, $P_2$ and $P_3$.

Figure 3:
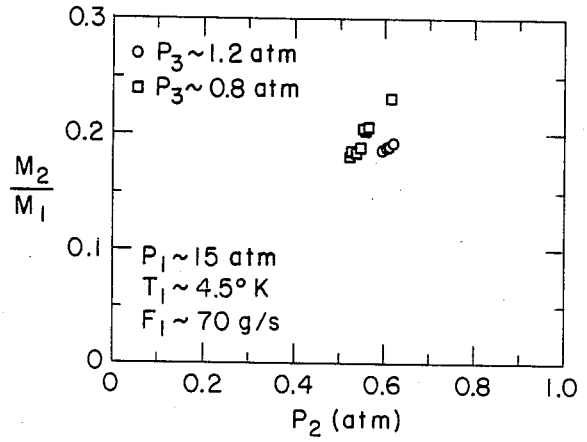
FIG. 3 is a graph illustrating the mass flow ratio of the ejector shown in the apparatus depicted in FIG. 1, versus suction pressure of the ejector for the two conditions where (1) the discharge pressure of the ejector is not affected by a cold compressor, and (2) the discharge pressure of the ejector is reduced by a cold compressor, according to the invention.

To illustrate the improvement obtained in the refrigeration apparatus shown in FIG. 1, FIG. 3 is a graphic illustration of the mass flow ratio ($M_2/M_1$) plotted versus ejector suction pressure ($P_2$). It will be understood that the secondary flow of the ejector 4 can be computed by dividing the cooling load by the latent heat of vaporization. A first test run was conducted with the refrigeration apparatus shown in FIG. 1, operated without the cold compressor 6 in the circuit. That condition yielded an output pressure $P_3$ of about 1.2 atmospheres at the port 4C of ejector 4. As shown by the four circles for that test run, as plotted in FIG. 3, for a suction pressure $P_2$ of about 0.6 atmospheres, the refrigeration apparatus when thus operated without the cold compressor produced a mass flow ratio $M_2/M_1$ of about 0.2. On the other hand, when the refrigeration apparatus shown in FIG. 1 was operated, according to the invention, with a cold compressor 6 installed downstream from the ejector 4 to form a two-stage pumping system, the various test run results shown by the squares plotted in FIG. 3 were obtained. For that second test run, the cold compressor 6 was operated to produce an output pressure $P_3$ at output port 4C of ejector 4 equal to approximately 0.8 atmospheres. Accordingly, for a suction pressure $P_2$ of about 0.6 atmospheres, it can be seen in FIG. 3 that a corresponding mass flow ratio $M_2/M_1$ of about 0.23 was obtained. Such a significant improvement in the mass flow ratio demonstrates that the desired objective of improved operating efficiency of the refrigeration apparatus is provided by the two-stage pumping system in the refrigeration apparatus of the invention.

In conducting the tests of the refrigeration apparatus reflected ih the data of FIG. 3, wherein the mass flow ratio $M_2/M_1$ was measured relative to the suction pressure $P_2$ of the ejector 4, the main input pressure $P_1$ at the primary input 4A of ejector 4 was maintained at approximately 15 atmospheres. Also, the temperature $T_1$ of the input refrigerant at first ejector input 4A was maintained at approximately 4.5° K. and the flow rate $F_1$ at the first input 4A was maintained at approximately 70 grams per second (g/s).

As pointed out above in the description of the apparatus of the preferred embodiment of the invention, a mist collector 7 is preferably used fo prevent liquid helium, or other liquid refrigerant, from being moved from the precooler 2 into the cold compressor 6. In the test results shown in FIGS. 2 and 3, the refrigeration apparatus was operated without such a mist collector (7); thus, due to liquid carryover from the precooler 2 to the cold compressor 6, the most accurate possible measurement of the efficiency for the cold compressor 6 was not obtained. However, preliminary test results indicate that the cold compressor 6, when operated with the lowest possible liquid carryover, has an adiabatic efficiency of about 50%.

Figure 4:
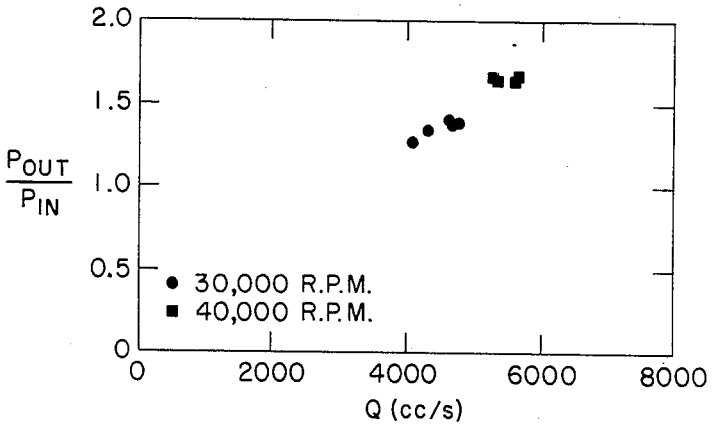
FIG. 4 is a graph showing pressure ratio versus volume flow rate for a cold compressor, such as that illustrated in FIG. 1, for the two cases when the compressor is operated at two different speeds.

FIG. 4 graphically illustrates still further test results that were obtained in operating the refrigeration apparatus shown in FIG. 1, except without a mist collector (7) installed therein. In the graph of FIG. 4, the pressure ratio for cold compressor 6, i.e., its output pressure $P_{out}$ divided by its input pressure $P_{in}$ is plotted as a function of two cold compressor (6) operating speeds; namely, 30,000 revolutions per minute, as shown by the circles in FIG. 4, and 40,000 R.P.M., as shown by the squares plotted in FIG. 4 for that speed. It was observed during these tests that the gas seal pressure on the cold compressor 6 has a large effect on the measured compressor efficiency. As a consequence of these test results, it was found desirable to reduce the warm helium gas seal overpressure to a minimum level of about 0.07 atmospheres, as mentioned above. The reduction in warm helium gas seal pressure also helped make it possible to obtain the relatively high 20% improvement in efficiency that was realized, as reported above. A conventional commercially available labyrinth seal was used on the cold compressor 6 to isolate the warm helium seal gas from the process helium refrigerant gas.

Although the test results measured an improvement in refrigeration efficiency of at least 20%, the applicant believes that further significant improvement is possible for the refrigeration apparatus shown in FIG. 1, by further improving the design of the ejector 4. However, it has been clearly established that the use of a cold compressor (6) in series with even a conventional, commercially available ejector (4), is an effective way to produce the desired low pressure in a helium refrigeration system. So far as the applicant is aware, this is the first example of the use of a cold compressor which operates successfully in this temperature and flow range, downstream from an ejector, in a two-stage refrigerant pumping system. Certainly, when compared with a refrigeration system that uses only an ejector, the provision of refrigeration apparatus of the invention, which combines a cold compressor and an ejector into a two-stage pumping system, results either in the production of a lower temperature on the same load, or results in more cooling of a load at the same temperature, as explained in detail above.

It will be recognized by those skilled in the art that various further modifications and improvements can be made in the invention, based on the disclosure of it presented herein. Thus, it is my intention to encompass within the following claims the true spirit and scope of the invention.

I claim:

1. A refrigeration apparatus having a heat exchanger, a precooler, a subcooler and an ejector, all operably interconnected with conduit means that are effective to carry refrigerant; from the heat exchanger to a first input of the ejector, from the output of the ejector to the precooler, from the precooler to both the subcooler and the heat exchanger, as well as from the subcooler to a second input of the ejector, and including the improvement comprising a cold compressor operably connected to reduce the discharge pressure of the ejector, thereby to improve the operating efficiency of said refrigeration apparatus.

2. A refrigeration apparatus as described in claim 1 wherein said cold compressor is operably connected by said conduit means between said precooler and the heat exchanger.

3. A refrigeration apparatus as defined in claim 2 including a mist collector operably connected by said conduit means between the precooler and said cold compressor, said mist collector being effective to prevent liquid from being carried from the precooler to the cold compressor, thereby to improve the operating efficiency of the cold compressor.

4. A refrigeration apparatus as defined in claim 1 wherein said cold compressor is operably connected by said conduit means between said output of the ejector and said precooler.

5. A refrigeration apparatus as defined in claim 1 wherein said cold compressor is operably connected by said conduit means to the downstream side of said heat exchanger, thereby to form with said ejector a two-stage pumping system for moving refrigerant from the first input of the ejector to said downstream side of the heat exchanger.

* * * * *